US009084055B2

(12) United States Patent
Brunner et al.

(10) Patent No.: US 9,084,055 B2
(45) Date of Patent: Jul. 14, 2015

(54) AUDIO LISTENING SYSTEM

(75) Inventors: Robert Brunner, San Francisco, CA (US); Gregoire Vandenbussche, San Francisco, CA (US); Chris Fruhauf, San Anselmo, CA (US)

(73) Assignee: APPLE INC., Cupertino, CA (US)

( * ) Notice: Subject to any disclaimer, the term of this patent is extended or adjusted under 35 U.S.C. 154(b) by 2 days.

(21) Appl. No.: 13/517,035

(22) PCT Filed: Dec. 22, 2011

(86) PCT No.: PCT/US2011/067045

§ 371 (c)(1), (2), (4) Date: Sep. 11, 2013

(87) PCT Pub. No.: WO2012/094176

PCT Pub. Date: Jul. 12, 2012

(65) Prior Publication Data

US 2013/0343591 A1 Dec. 26, 2013

Related U.S. Application Data

(60) Provisional application No. 61/429,426, filed on Jan. 3, 2011.

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.

CPC ..... *H04R 1/1091* (2013.01); *H04R 1/1066* (2013.01); *H04R 1/1075* (2013.01); *H04R 5/0335* (2013.01)

(58) Field of Classification Search

CPC .. H04R 1/1066; H04R 5/0335; H04R 1/1008; H04R 5/033; H04R 1/1075

USPC ..... 381/371, 374, 378, 379

See application file for complete search history.

(56) References Cited

U.S. PATENT DOCUMENTS

| | | | |
|---|---|---|---|
| 1,066,511 | A | 7/1913 | Markoff |
| 2,025,385 | A | 12/1935 | Grace et al. |

(Continued)

FOREIGN PATENT DOCUMENTS

| | | |
|---|---|---|
| GB | 2072035 A | 9/1981 |
| JP | D1318386 | 5/1986 |

(Continued)

OTHER PUBLICATIONS

Search Report and Written Opinion for PCT Application No. PCT/US11/67045 dated Sep. 27, 2012.

(Continued)

*Primary Examiner* — Curtis Kuntz
*Assistant Examiner* — Ryan Robinson
(74) *Attorney, Agent, or Firm* — Ganz Pollard, LLC

(57) ABSTRACT

A headphone assembly is provided and includes a headband assembly comprising at least one end; an ear-cup assembly pivotably engaged to the headband assembly by an engagement structure positioned proximate to the at least one end of the headband assembly, the ear-cup assembly comprising a cap and a housing, wherein the cap and the housing are connected to form an enclosed space inside the ear-cup assembly; a transducer configured to produce sound and positioned within the enclosed space of the ear-cup assembly; and a damper rim positioned between the ear-cup assembly and the at least one end of the headband assembly, the damper rim covering the engagement structure and being engaged to the ear-cup assembly and the at least one end of the headband assembly.

18 Claims, 6 Drawing Sheets

(56) References Cited

U.S. PATENT DOCUMENTS

| | | | | |
|---|---|---|---|---|
| 2,149,341 | A | 3/1939 | Harrison | |
| 2,336,669 | A | 12/1943 | Brown et al. | |
| 2,481,387 | A | 9/1949 | Bonecutter | |
| 2,487,787 | A | 11/1949 | Brown | |
| 2,653,193 | A | 9/1953 | Anderson | |
| 2,993,962 | A | 7/1961 | Hothem | |
| 3,104,398 | A | 9/1963 | Palmaer | |
| D203,677 | S | 2/1966 | Spilman et al. | |
| 3,902,120 | A * | 8/1975 | Dascal et al. | 381/309 |
| D244,300 | S | 5/1977 | Besasie | |
| 4,048,453 | A | 9/1977 | Seidel | |
| 4,173,715 | A | 11/1979 | Gosman | |
| D254,183 | S | 2/1980 | Doodson | |
| D254,876 | S | 5/1980 | Reitenga | |
| 4,609,786 | A | 9/1986 | Omoto et al. | |
| 4,634,816 | A | 1/1987 | O'Malley et al. | |
| 4,875,233 | A | 10/1989 | Derhaag | |
| 4,965,836 | A * | 10/1990 | Andre et al. | 381/370 |
| D313,092 | S | 12/1990 | Nilsson | |
| 5,018,599 | A | 5/1991 | Dohi et al. | |
| 5,035,005 | A | 7/1991 | Hung | |
| D328,074 | S | 7/1992 | Yamazaki et al. | |
| D328,461 | S | 8/1992 | Daido et al. | |
| D338,010 | S | 8/1993 | Yamatogi | |
| D351,172 | S | 10/1994 | Nakamura et al. | |
| D353,821 | S | 12/1994 | Hammer et al. | |
| 5,369,857 | A | 12/1994 | Sacherman et al. | |
| D358,389 | S | 5/1995 | Isono | |
| D375,825 | S | 11/1996 | Whidden | |
| D403,128 | S | 12/1998 | Scanlon et al. | |
| D420,356 | S | 2/2000 | Suzuki | |
| D422,592 | S | 4/2000 | Deguchi | |
| 6,081,604 | A | 6/2000 | Hikichi et al. | |
| D430,140 | S | 8/2000 | Roman | |
| D435,249 | S | 12/2000 | Yasutomi | |
| 6,163,615 | A | 12/2000 | Callahan | |
| 6,195,839 | B1 | 3/2001 | Patterson et al. | |
| D457,512 | S | 5/2002 | Yoneda | |
| 6,449,806 | B1 | 9/2002 | Engelhard et al. | |
| D468,723 | S | 1/2003 | Pham | |
| 6,542,615 | B1 | 4/2003 | Ito | |
| 6,611,963 | B2 | 9/2003 | Woo et al. | |
| D484,485 | S | 12/2003 | Matsuoka | |
| 6,654,966 | B2 | 12/2003 | Rolla et al. | |
| D484,868 | S | 1/2004 | Suzuki | |
| 6,678,897 | B2 | 1/2004 | Lindgren | |
| 6,724,906 | B2 * | 4/2004 | Naksen et al. | 381/379 |
| D491,163 | S | 6/2004 | Green | |
| D502,938 | S | 3/2005 | Tokioka | |
| D504,414 | S | 4/2005 | Yoshida | |
| D504,883 | S | 5/2005 | Jacobson et al. | |
| D512,381 | S | 12/2005 | Sirichai et al. | |
| D512,708 | S | 12/2005 | Harris, Jr. et al. | |
| D512,981 | S | 12/2005 | Jacobson et al. | |
| D514,086 | S | 1/2006 | Skulley | |
| D517,043 | S | 3/2006 | Jacobson et al. | |
| D517,528 | S | 3/2006 | Skulley | |
| 7,072,483 | B2 | 7/2006 | Lenhard-Backhaus | |
| D532,407 | S | 11/2006 | Motoishi | |
| D534,155 | S | 12/2006 | Obata | |
| D534,156 | S | 12/2006 | Obata | |
| 7,172,052 | B2 | 2/2007 | Lenhard-Backhaus | |
| D539,788 | S | 4/2007 | Thompson | |
| D540,301 | S | 4/2007 | Obata | |
| D540,303 | S | 4/2007 | Rausch | |
| D540,778 | S | 4/2007 | Thompson | |
| D541,255 | S | 4/2007 | Taylor | |
| D541,256 | S | 4/2007 | Rausch | |
| D541,257 | S | 4/2007 | Thursfield | |
| D552,077 | S | 10/2007 | Brunner | |
| D557,684 | S | 12/2007 | Pundsack et al. | |
| D560,654 | S | 1/2008 | Feng | |
| D563,382 | S | 3/2008 | Wikel | |
| D563,995 | S | 3/2008 | Deguchi | |
| D570,825 | S | 6/2008 | Schultz et al. | |
| D582,890 | S | 12/2008 | Koza | |
| D584,715 | S | 1/2009 | Brennwald | |
| D585,870 | S | 2/2009 | Zheng | |
| D585,871 | S | 2/2009 | Lee | |
| D585,872 | S | 2/2009 | Lee | |
| D588,098 | S | 3/2009 | Kurihara | |
| D588,100 | S | 3/2009 | Densho | |
| D591,263 | S | 4/2009 | Shimizu | |
| D592,182 | S | 5/2009 | Sanguinetti | |
| D592,640 | S | 5/2009 | Tkachuk | |
| D593,995 | S | 6/2009 | Shimizu | |
| D600,674 | S | 9/2009 | Brennwald | |
| D602,906 | S | 10/2009 | Groves et al. | |
| D603,370 | S | 11/2009 | Suzuki | |
| D603,371 | S | 11/2009 | Boateng et al. | |
| D616,865 | S | 6/2010 | Marchand et al. | |
| D617,769 | S | 6/2010 | Birger | |
| D617,771 | S | 6/2010 | Groves et al. | |
| 7,735,154 | B2 | 6/2010 | Gellis et al. | |
| D625,705 | S | 10/2010 | Ohori et al. | |
| D632,668 | S | 2/2011 | Brunner et al. | |
| D633,896 | S | 3/2011 | Kondo et al. | |
| D635,959 | S | 4/2011 | Hutchieson | |
| D637,176 | S | 5/2011 | Brunner et al. | |
| D637,998 | S | 5/2011 | Brunner et al. | |
| D637,999 | S | 5/2011 | Brunner et al. | |
| D638,000 | S | 5/2011 | Hoggarth | |
| D639,776 | S | 6/2011 | Arimoto | |
| D641,725 | S | 7/2011 | Chong et al. | |
| D648,330 | S | 11/2011 | Fischer | |
| D652,017 | S | 1/2012 | Groves et al. | |
| D652,405 | S | 1/2012 | Lee et al. | |
| D652,406 | S | 1/2012 | Lee et al. | |
| 8,098,873 | B2 * | 1/2012 | Furuya et al. | 381/374 |
| D654,471 | S | 2/2012 | Fischer | |
| D654,472 | S | 2/2012 | Fischer | |
| 8,139,807 | B2 * | 3/2012 | Reiss et al. | 381/375 |
| D657,344 | S | 4/2012 | Brunner et al. | |
| D657,345 | S | 4/2012 | Brunner et al. | |
| D657,776 | S | 4/2012 | Lee et al. | |
| D660,823 | S | 5/2012 | Hardi et al. | |
| D660,824 | S | 5/2012 | Hardi et al. | |
| D660,826 | S | 5/2012 | Brunner et al. | |
| D662,490 | S | 6/2012 | McSweyn | |
| D663,716 | S | 7/2012 | Hardi et al. | |
| D668,633 | S | 10/2012 | Enquist et al. | |
| D673,520 | S | 1/2013 | Tan | |
| D674,767 | S | 1/2013 | Brunner et al. | |
| D677,647 | S | 3/2013 | Lee et al. | |
| D677,648 | S | 3/2013 | Lee et al. | |
| 8,422,718 | B2 * | 4/2013 | Santiago | 381/379 |
| D683,329 | S | 5/2013 | Hagelin | |
| D689,843 | S | 9/2013 | Lee | |
| D691,112 | S | 10/2013 | Brunner et al. | |
| D691,579 | S | 10/2013 | Lee et al. | |
| D695,263 | S | 12/2013 | Mogili | |
| D696,226 | S | 12/2013 | Brunner et al. | |
| 8,605,935 | B1 * | 12/2013 | Huang | 381/381 |
| 2003/0182713 | A1 | 10/2003 | Rolla | |
| 2003/0210801 | A1 | 11/2003 | Naksen et al. | |
| 2004/0216946 | A1 | 11/2004 | Lenhard-Backhaus | |
| 2005/0053255 | A1 | 3/2005 | Harris et al. | |
| 2005/0226452 | A1 | 10/2005 | Amae et al. | |
| 2006/0001307 | A1 | 1/2006 | Embach | |
| 2006/0062417 | A1 | 3/2006 | Tachikawa | |
| 2006/0104471 | A1 | 5/2006 | Tsunoda et al. | |
| 2008/0056525 | A1 | 3/2008 | Fujiwara et al. | |
| 2009/0220118 | A1 | 9/2009 | Meier et al. | |
| 2010/0128884 | A1 | 5/2010 | Sapiejewski et al. | |
| 2010/0284558 | A1 | 11/2010 | Kimura et al. | |
| 2011/0206216 | A1 | 8/2011 | Brunner et al. | |
| 2011/0216909 | A1 | 9/2011 | Sapiejewski et al. | |

FOREIGN PATENT DOCUMENTS

| | | |
|---|---|---|
| JP | D1406347 | 10/1987 |
| JP | D1430542 | 3/1988 |
| JP | 200631444 | 6/1994 |

(56) References Cited

FOREIGN PATENT DOCUMENTS

| | | | |
|---|---|---|---|
| KR | 300476152 | | 1/2008 |
| WO | 2007103561 | A2 | 9/2007 |
| WO | 2012094176 | A2 | 7/2012 |

OTHER PUBLICATIONS

Office Action dated Dec. 10, 2010 for Russian Patent Application No. 2010501890.
Search Report dated Mar. 31, 2011 for Taiwan patent Application No. 099303306.
Taiwan Office Action for Taiwan Application No. 101303990 dated Aug. 26, 2013.
Taiwan Office Action for Taiwan Application No. 101301117 dated Aug. 26, 2013.
Taiwan Office Action for Taiwan Application No. 102302000 dated Aug. 26, 2013.
Unpublished pending U.S. Appl. No. 29/471,109, filed Oct. 28, 2013 a copy of which is not being furnished herewith, pursuant to the Commissioner's Notice dated Sep. 21, 2004.
Unpublished pending U.S. Appl. No. 29/475,634, filed Dec. 4, 2013 a copy of which is not being furnished herewith, pursuant to the Commissioner's Notice dated Sep. 21, 2004.
Unpublished pending U.S. Appl. No. 13/925613, filed Jun. 24, 2013 a copy of which is not being furnished herewith, pursuant to the Commissioner's Notice dated Sep. 21, 2004.
Unpublished pending U.S. Appl. No. 13/517035, filed Sep. 11, 2013 a copy of which is not being furnished herewith, pursuant to the Commissioner's Notice dated Sep. 21, 2004.

* cited by examiner

AUDIO LISTENING SYSTEM

CROSS-REFERENCE TO RELATED APPLICATIONS

This application is a national stage patent application of PCT/US11/67045 which was filed on Dec. 22, 2011, that claims priority from U.S. Patent Application Ser. No. 61/429,426, filed Jan. 3, 2011, both of which are incorporated by reference in their entirety.

BACKGROUND OF THE INVENTION

The description that follows relates generally to headphones. In particular, the description relates to an improved audio listening system with improved audio output and improved earphone configurations.

Commercially available headphones typically comprise a pair of earphones, or ear-cups, coupled to one another by a resilient curved band, e.g., a headband, that applies sufficient force to the ear-cups to hold the headphones in place on the user's head. Ear-cups are designed to be positioned close to the auditory canal of the user's ear to create an acoustically necessary coupling space there between. If the ear-cup is not positioned squarely on the user's outer ear, the force holding the headphone in place may be concentrated on one part of the user's ear, causing the ear to become sore. Moreover, the uniqueness of each user's ear shape creates a problem for designing ear-cups that universally provide a comfortable and close fit to the outer part of the ear. Because today's users tend to wear headphones for relatively longer periods of time, the ability to completely and comfortably adjust a headphone to each particular user is becoming as important of a feature to consumers as the acoustical parameters of the headphone.

In commercially available headphones, the ear-cup design may produce different acoustic effects. For example, open-back ear-cup designs, e.g., where the back of the ear-cup is open, generate a more natural or speaker-like sound and provide a more spacious "soundscape," i.e. the perception of distance from the audio source. However, open-back ear-cups tend to leak more sound and let more ambient sounds into the headphone. In contrast, closed-back designs, e.g., where the back of the ear-cup is closed, may effectively block out ambient noise (depending on the model, between 8-32 dB). However, closed-back ear-cups have a smaller soundscape, giving the wearer a perception that the sound is coming from within their head.

Many of today's headphone users also require greater portability from a headphone, as the combination of the Internet and smart phones have made music, video, and online applications available virtually anywhere and at anytime. Among commercially available headband type headphones, a few of them can be folded into a compact form when not in use, thereby protecting the headphones when not in use and increasing their portability. In addition, with greater mobility comes increased visibility, and so, for some users, headphones have become a form of artistic expression, making the aesthetic appeal of the headphone an important feature as well.

An example of a conventional headphone may be found in U.S. Pat. No. 4,965,836 to Eugene M. Andre et. al., which is directed to a headphone with dual-transducers in each ear-cup with a closed-back design. The '836 patent describes a headphone that uses a bellows member with an accordion-type cross section to seal a sizable, flexible gap between the two sides of each ear-cup, i.e., a faceplate and a cover, in order to enclose and direct sound waves generated by the dual-transducers. However, because the accordion-shaped bellows member allows flexibility, or movement, between the two ends of the ear-cup, the total volume enclosed within each ear-cup is independently variable depending on how much pressure is applied to each ear-cup while the user is wearing the headphone. As will be appreciated by those skilled in the art, the volume, or amount of air, within a closed-back ear-cup influences the acoustic characteristics of the sound produced by the transducer included therein. Thus, it would seem that the sound quality of the headphone in the '836 patent is at least partially dependent on how much or how little each bellows member is compressed when the ear-cups are placed against the user's ears. In addition to producing inconsistent sound quality, this bellows member in the '836 patent detracts from the aesthetic appeal and portability of the headphone by increasing the bulk and thickness of the ear-cups.

Accordingly, there still exists a need in the art for a slimmer, sleeker headphone design that provides comfortable long wear, superior sound quality, and convenient portability.

SUMMARY OF THE INVENTION

The present invention is defined by the appended claims. This description summarizes some aspects of the present embodiments and should not be used to limit the claims.

The foregoing problems are solved and a technical advance is achieved by an audio listening device having ear-cups that are pivotably engaged to a headband assembly by an engagement structure positioned within a damper rim.

One embodiment includes a headphone assembly. The headband assembly includes at least one end and an ear-cup assembly pivotably engaged to the headband assembly by an engagement structure positioned proximate to the at least one end of the headband assembly. The ear-cup assembly includes a cap and a housing, wherein the cap and the housing are connected to form an enclosed space inside the ear-cup assembly. The headphone assembly may further include a transducer configured to produce sound and positioned within the enclosed space of the ear-cup assembly. The headphone assembly may further include a damper rim positioned between the ear-cup assembly and the at least one end of the headband assembly, wherein the damper rim covers the engagement structure and is engaged to the ear-cup assembly and the at least one end of the headband assembly.

Other articles of manufacture, features, and advantages of the present invention will be, or will become, apparent to one having ordinary skill in the art upon examination of the following drawings and detailed description. It is intended that all such additional articles of manufacture, features, and advantages included within this description be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

Illustrative and exemplary embodiments of the invention are described in further detail below with reference to and in conjunction with the figures.

DETAILED DESCRIPTION

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the disclosure is intended to cover all such embodiments that may fall within the scope of the appended claims, either literally or under the doctrine of equivalents.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Figure 1:
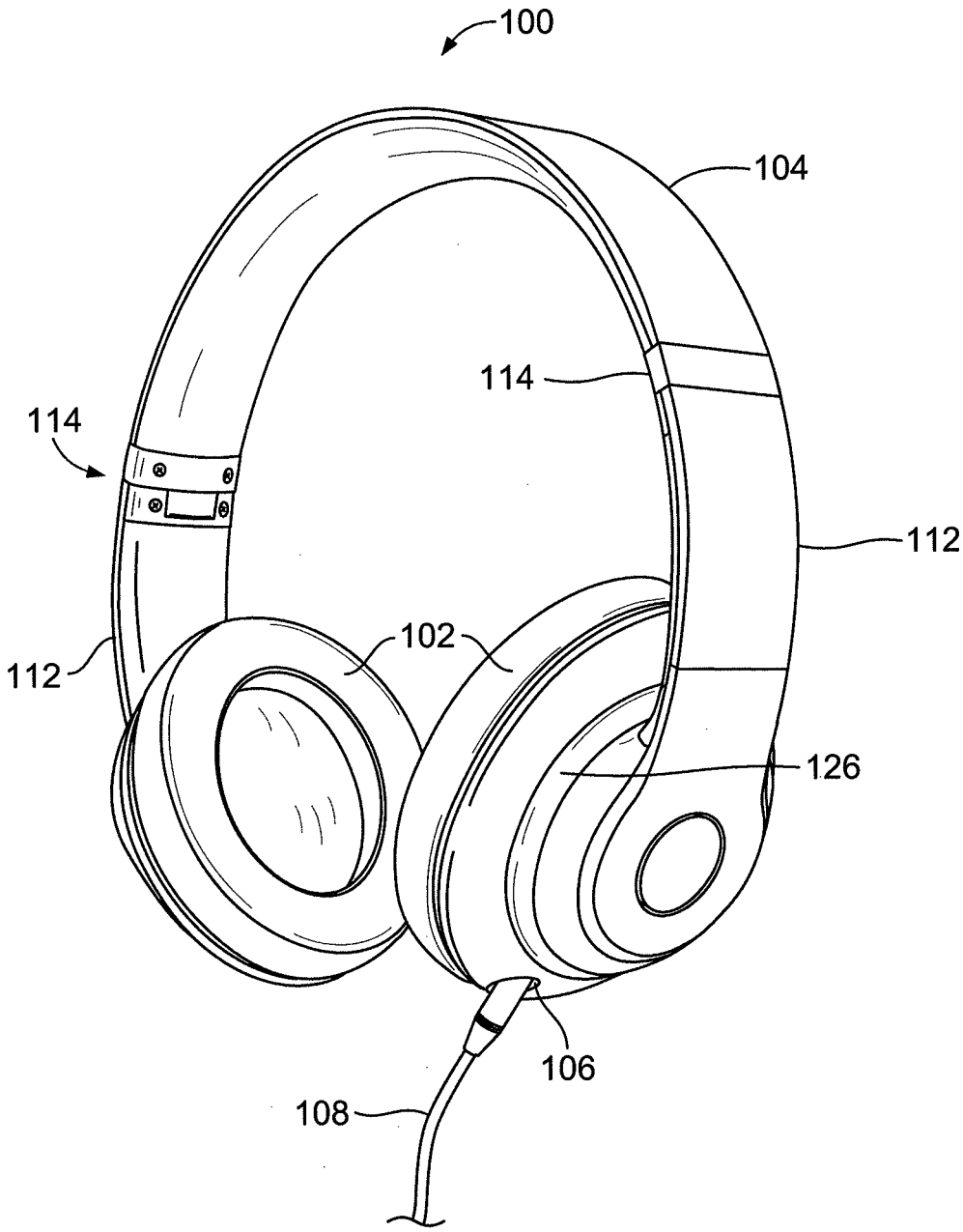
FIG. 1 is a diagram showing a perspective view of an embodiment of a headphone.

FIG. 1 illustrates an embodiment of an audio listening system, or headphone 100. The headphone 100 includes a pair of ear-cups 102 (also referred to herein as an ear-cup assembly) which are interconnected by the two ends of a substantially U-shaped or C-shaped, flexible or elastic, and resilient headband assembly 104. The headband assembly 104 has an adjustable curvature so as to be arranged along a portion of the head or neck of the user or wearer. In one embodiment, the headphone 100 is constructed from strong yet lightweight aluminum, which helps minimize vibrations, thereby minimizing unwanted audio artifacts.

At least one of the ear-cups 102 includes a cable port 106. In practice, by plugging a headphone cable 108 into the cable port 106, the headphone wearer may use the headphone 100 to listen to audio signals being transmitted through the headphone cable 108. In one embodiment, each of the ear-cups 102 includes a cable port 106, and the cable ports 106 operate as input/output cable ports for inputting audio signals through one cable port 106 and outputting audio signals through the second cable port 106 to, for example, a second headphone set (not shown). Other mechanisms for transmitting signals to (and from) headphone 100 may be provided, such as alternative locations for cable port(s) 106 or the integration of wireless connectivity (such as, e.g., Bluetooth), without departing from the description herein.

Figure 2:
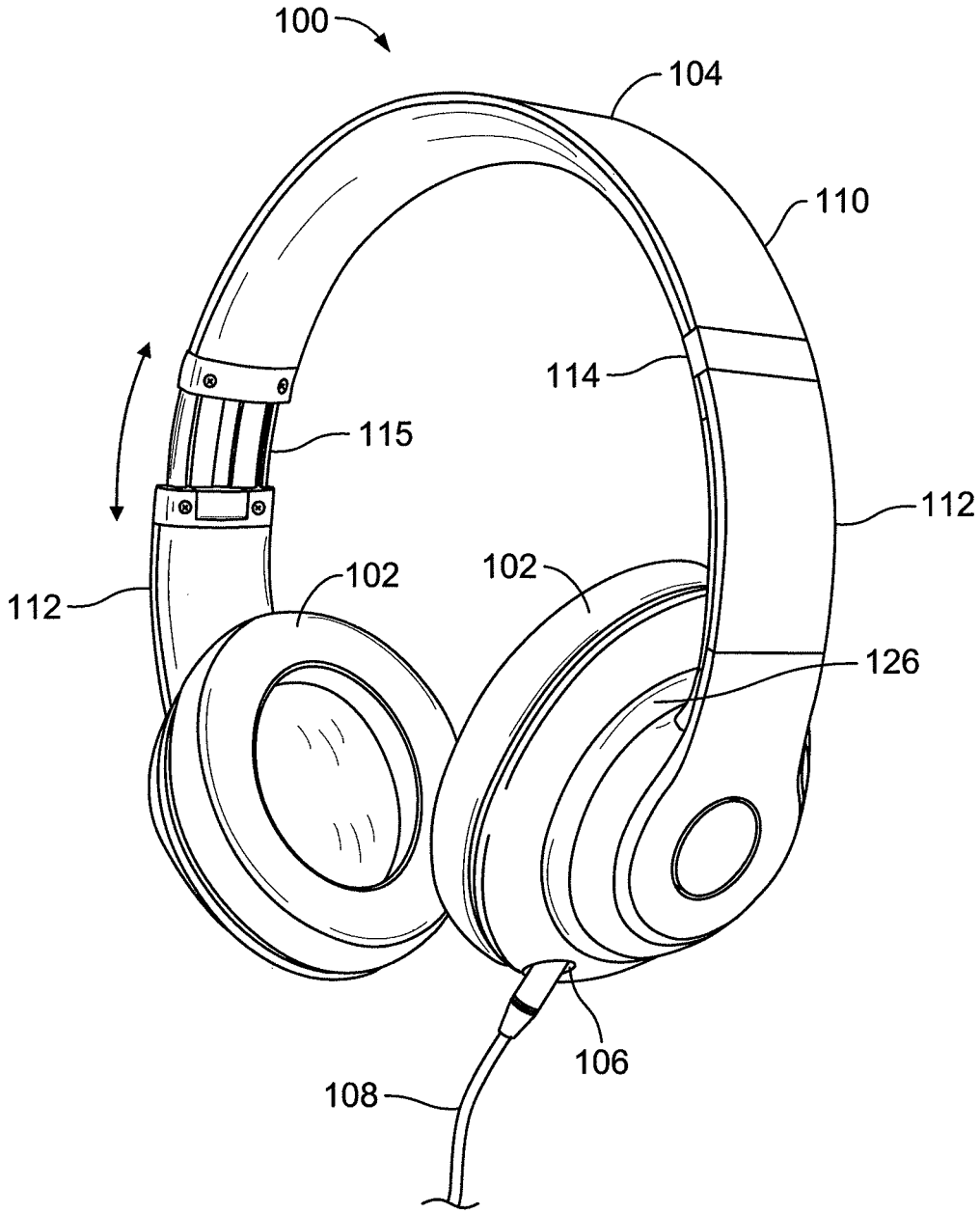
FIG. 2 is a diagram showing a perspective view of the headphone of FIG. 1 with one extended sliding member in accordance with one embodiment.
Figure 4:
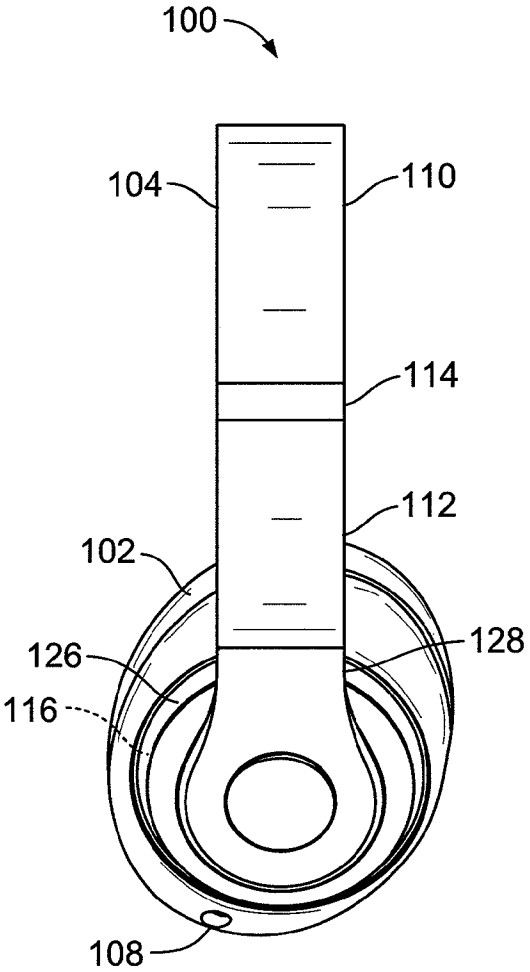
FIG. 4 is a diagram showing a side view of the headphone of FIG. 1.
Figure 3:
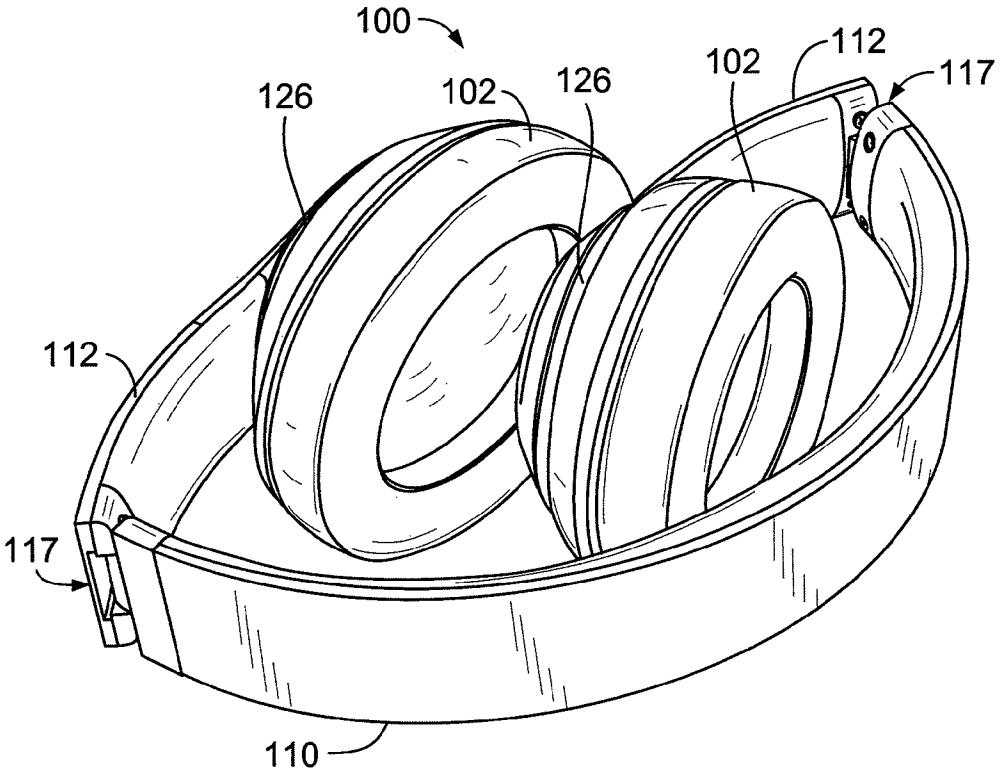
FIG. 3 is a diagram showing a perspective view of the headphone of FIG. 1 with the ear-cups folded in the space underneath the headband in accordance with one embodiment.
Figure 5:
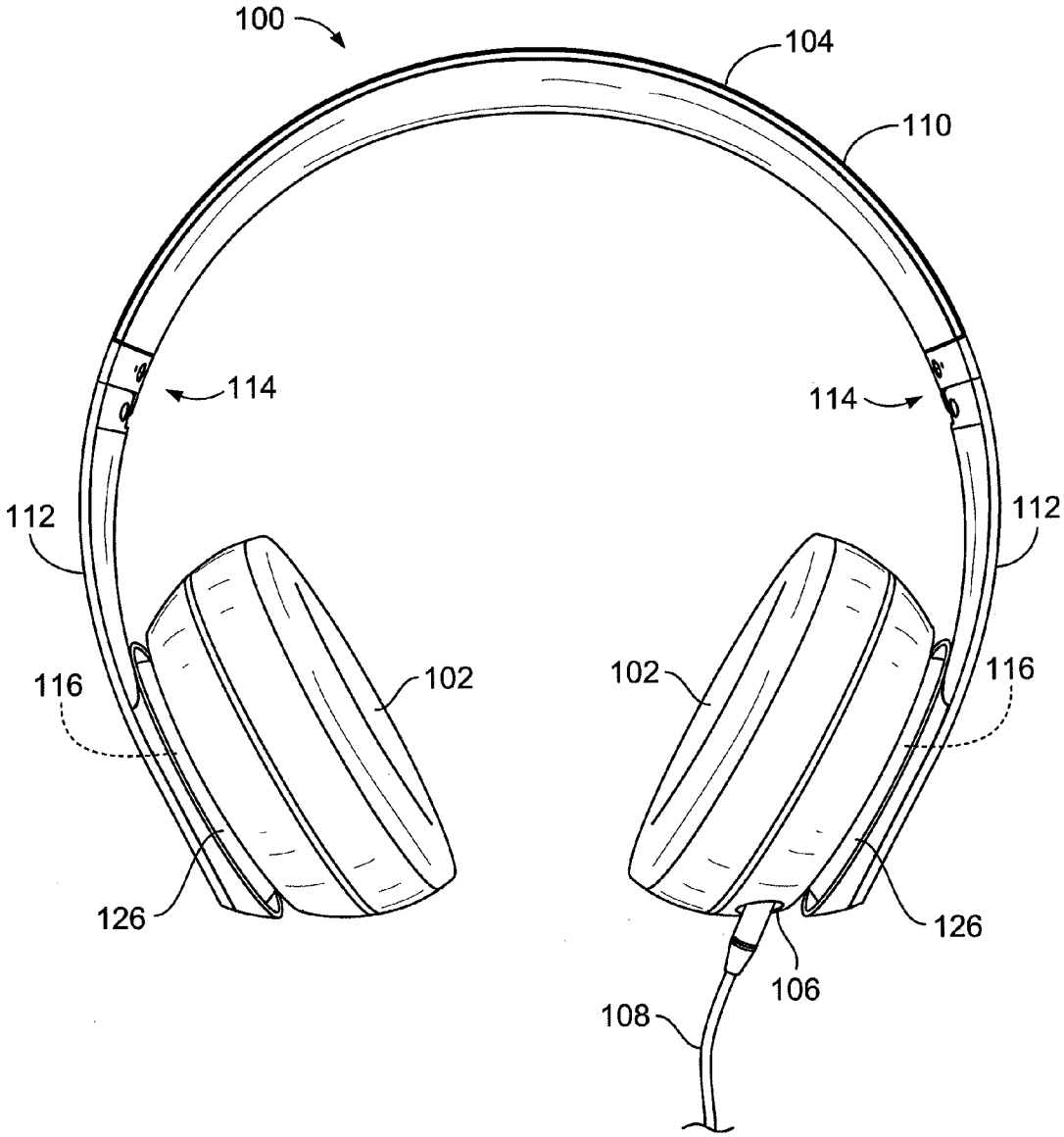
FIG. 5 is a diagram showing a front view of the headphone of FIG. 1.

Referring additionally to FIGS. 2 and 3, in accordance with one embodiment, the headband assembly 104 includes a headband 110 and a bow-shaped arm 112 at each end of the headband assembly 104. An ear-cup 102 is pivotally attached to each arm 112. The headband 110 includes a pair of sliding members 114, each having an extension 115 that can slide internally and relatively to one end of the headband 110. The headband 110 and the pair of sliding members 114 are coupled via a friction-based adjust mechanism, generated by external surfaces of the extensions 115 and corresponding internal surfaces of a channel (not shown) formed internally to the headband 110. Oppositely to the headband 110, each of the arms 112 is attached to a respective one of the sliding members 114.

The friction-based adjust mechanism, provided at both ends of the headband 110, is a mechanism for adjusting the size of the headphone 100 so as to adapt to the size of the wearer's head. To that end, the sliding members 114 are formed so as to create a biasing frictional force when they are slid relatively to the headband 110. Before the headphone 100 is fitted onto the wearer's head, each of the sliding members 114 can be substantially hidden within the corresponding channel. In this position, the distance between each of the headphone units 102 and the apex of the headband 110 is minimal, thus corresponding to the smallest head size that can comfortably accept or wear the headband 110. When the wearer puts on the headphone 100 by holding the earphone units 102 in his/her hands, he/she can adjust the headphone 100 by simply applying a force slightly greater than the frictional forces exerted by the sliding members 114 onto the channel to slide down the earphone units 102 towards his/her ears.

As shown in FIG. 3, in one embodiment the headband assembly 104 includes a folding mechanism 117 for folding the headphone 100 into a closed position when not in use. The folding mechanism 117 allows the arms 112, and their associated ear-cups 102, to be rotated inward to the closed position and housed in the internal space formed by the headband 110. The headphone 100 may be moved to an open position by rotating the arms 112 outward about the folding mechanism 117. In one embodiment, the folding mechanism 117 is a hinge designed to allow rotation of the arms 112 within a predetermined angle of rotation that is defined by the open position and the closed position.

Now referring to FIGS. 4-8, in accordance with one embodiment each of the arms 112 is engaged to a respective one of the ear-cups 102 via a respective one of engagement structures 116. As the connection point between the ear-cups 102 and the arms 112, the engagement structures 116 allow the ear-cups 102 to articulate or rotate in an infinite number of directions about an axis pointing into the head of the user, or approximately parallel to the ear canal. As a result, the engagement structures 116 enable the ear-cups 102 to adjust to any ear shape, thereby increasing the user's comfort-level when wearing the headphone 100.

Figure 7:
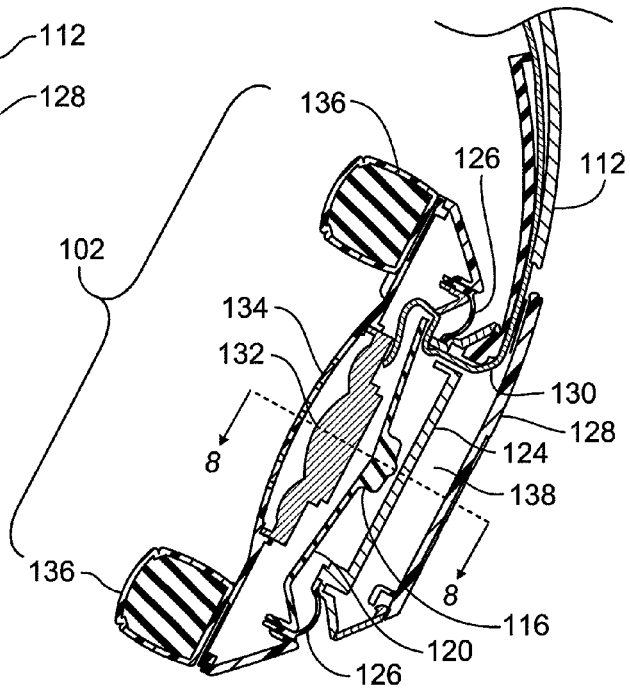
FIG. 7 is a diagram showing a cross-sectional view of the ear-cup of FIG. 6.
Figure 8:
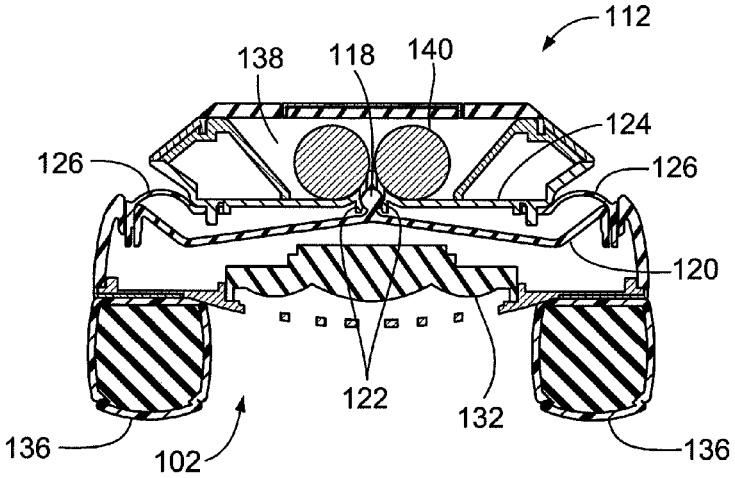
FIG. 8 is a diagram showing a cross-sectional view of the ear-cup of FIG. 7.

As shown in FIGS. 7 and 8, in one embodiment the engagement structures 116 form a ball-and-socket joint to connect the arms 112 and the ear-cups 102. To form the ball-and-socket joint, each engagement structure 116 includes a ball part 118, that is coupled to a ear-cup housing 120 of each of the ear-cups 102, and a socket part 122, that is coupled to an inner housing 124 of each of the arms 112. The ball part 118 mates with the socket part 122 to pivotably connect the arms 112 and the ear-cups 102. As an example, the ball part 118 may be a substantially spherical ball, and the socket part 122 may be formed by two, longitudinally placed ribs. In another embodiment, the ball part 118 is a circular assembly and the socket part 122 is a circular receptacle for receiving the circular assembly. It is contemplated that one skilled in the art may use other designs for forming the ball-and-socket joint in accordance with the teachings in this disclosure.

Each engagement structure 116 is positioned within and covered by a damper rim 126 to protect the engagement structure 116 from exposure to dust and other foreign particles. By covering the engagement structures 116, damper rims 126 also provide a smooth finish to the headphone 100 by hiding the engagement structures 116 from view. The damper rims 126 also couple the ear-cup 102 to the arms 112 by serving as resilient and flexible connection between the ear-cup housing 120 and the inner housing 124 of the arms 112. The damper rims 126 are positioned vertically, or substantially parallel to the outer cap 128 of the ear-cups 102, and operate to dampen movement of the ear-cups 102 and to generally maintain the position of the ear-cup 102 relative to the arms 112 and the headband 110, without providing undue pressure against the wearer's outer ear. Moreover, due to its slim profile, the damper rims 126 also reduce a thickness of the ear-cups 102, thereby giving the headphone 100 a sleek appearance overall and increasing its aesthetic appeal.

Figure 6:
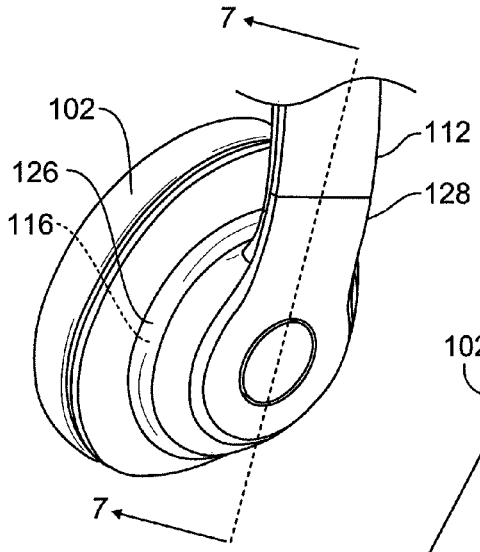
FIG. 6 is a diagram showing a perspective view of an ear-cup of the headphone of FIG. 1.

In one embodiment, the damper rim 126 may be designed as a bellows. Damper rims 126 may be composed of a suitable flexible and resilient material, such as, e.g., rubber or polyester foam. As shown in FIG. 6, for example, the damper rims 126 are visible from an outside view of the ear-cups 102. Damper rims 126 may further have a unique color to bolster the aesthetic appeal of the headphone 100. Also, by adding a color to the damper rims 126, the damper rims 126 are emphasized on the ear-cups 102, so as to visually create or mimic the look of a surround on a traditional speaker cone. For example, damper rims 126 may have a red-color to mimic the look of popular, commercially available red speaker surrounds. This further enhances the aesthetic appeal, and marketing value, of the headphone 100.

In one embodiment, each ear-cup 102 is acoustically enclosed on the back-side by the ear-cup housing 120, except for a small hole to allow routing of a cable 130 that electrically couples each ear-cup 102 to the headphone cable 108 connected to cable port 106. By acoustically sealing the back of each ear-cup 102 with ear-cup housing 120, the sound emitted from the rear of the transducer 132 is confined within each ear-cup 102, thereby enhancing the acoustic characteristics of the headphone 100. Each ear-cup 102 includes a transducer 132 for converting electrical signals into sound (for example, electrical signals received via the headphone cable 108). In part, transducer 132 produces sound by vibrating and pushing air forward. Ear-cup caps 134 cover each transducer 132 to protect the transducer 132 from the elements, such as dust, small particles, or other contamination. Each ear-cup cap 134 is positioned on a front-side of the ear-cup 102, so as to be directly opposite of the ear-cup housing 120, thereby creating an enclosed space around the transducer 132. The shape and size of this enclosed space determines, in part, the acoustic characteristics of the sound produced by the transducer 132. This enclosed space defines a fixed volume since the ear-cup housing 120 and the ear-cup cap 134 are relatively rigid components, i.e. not composed of flexible materials that significantly expand or contract when pressure is applied. The transducer 132 may be acoustically configured to produce optimal sound within the fixed volume formed by the enclosed space. As will be appreciated, internal sound reflections within the ear-cup housing 120 can degrade sound quality by producing standing waves and other forms of sound diffraction. To address these and other known issues, the ear-cup housing 120 may be constructed from absorptive materials (e.g., wool, synthetic fiber batting, etc.), and/or the internal shape of the space enclosed within each ear-cup 102 may be designed to reflect sounds away from the ear-cup cap 134, where they may then be absorbed. Each ear-cup cap 134 may include a specifically designed grid-like surface for enabling sound to radiate from the transducer 132 towards the user's ear. In one embodiment, the grid-like surface of the ear-cup cap 134 may be comprised of a wire or fabric mesh.

Cushioning doughnut-shaped ear pads 136 are wrapped circumferentially around the sound-radiating side of each ear-cup 102 for providing comfortable positioning on the user's ear. Due to the flexibility provided by the engagement structures 116 and the bow shape of the arm 112, when the headphone 100 is mounted on the wearer's head, each of the ear-cups 102 is completely self-adjustable with respect to the wearer's ear to become substantially parallel to the ear, thereby adopting an optimum position which minimizes the travel of the sound outside the ear pad 136. As such, the cushioned ear-cups 102 provide very comfortable listening, superior passive sound isolation, and minimize ear fatigue due to extended wear.

Figure 9:
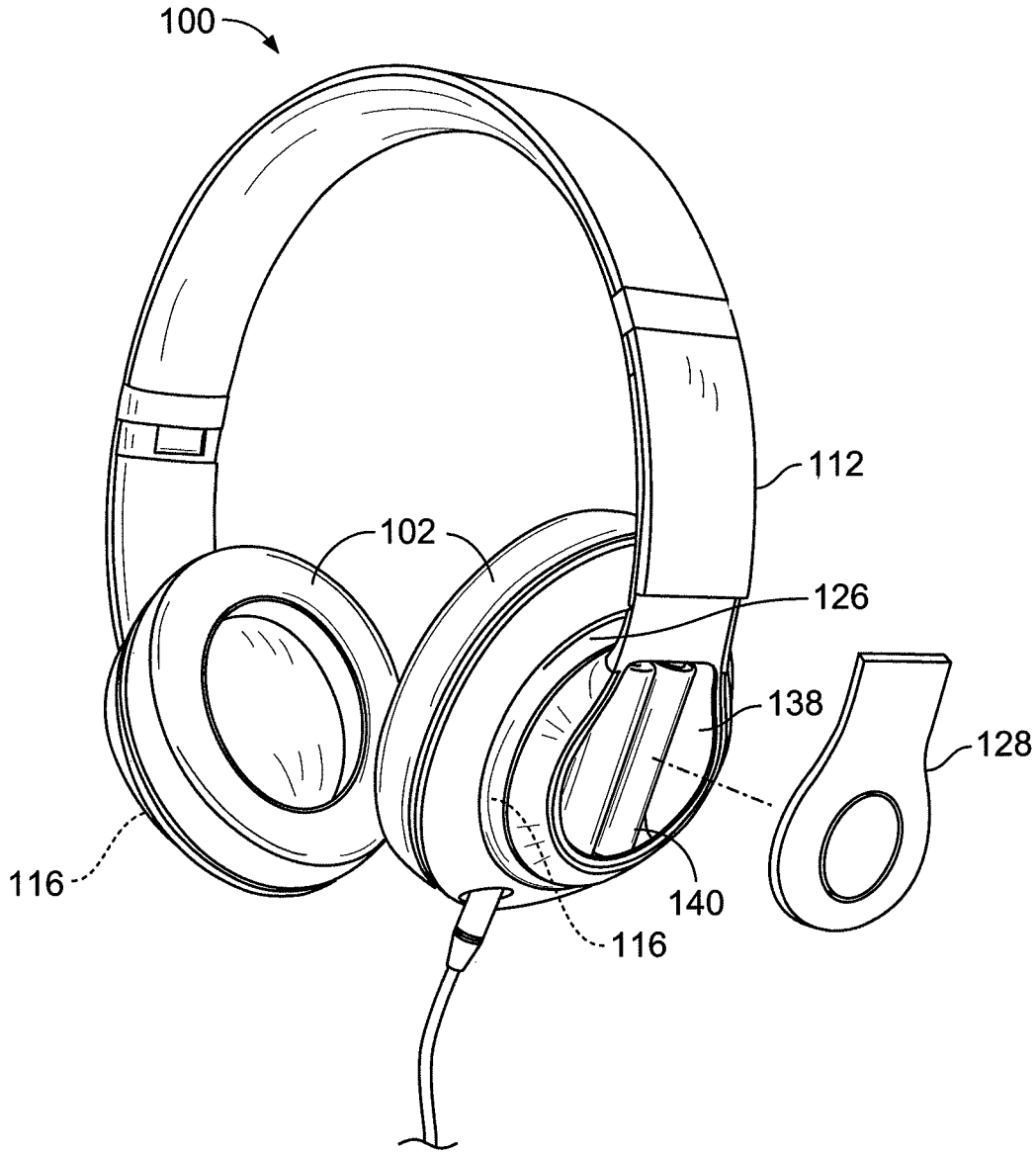
FIG. 9 is a diagram showing a front view of the headphone of FIG. 1 with the outer cap removed.

Referring additionally to FIG. 9, a cavity 138 in each of the arms 112 is formed between the outer cap 128 and the inner housing 124. The cavity 138 provides a space, e.g., battery compartment, that houses one or more batteries 140 for providing power to the headphone 100 and a printed circuit board (PCB) (not shown) that controls the provision of battery power to the headphone 100. FIG. 9 shows an embodiment in which the two batteries are required to power the headphone 100, and the cavity 138 is accordingly shaped and designed to accept two batteries. The disclosure is not limited to the illustrated configuration, and other types and/or quantities of batteries may be used in accordance with the teachings herein. By designing the arms 112 of the headphone 100 to include the cavity 138 for batteries 140, valuable space is saved, and the overall bulk of the headphone 100 is reduced.

Accordingly, the above-discussed headphone 100 provides a sleek, space-saving audio listening device that can be comfortably worn by the wearer for an extended listening period, when compared to commercially available headphones. By pivotably connecting ear-caps 102 to arms 112 using engagement mechanisms 116, and covering the engagement mechanisms 116 with flexible damper rims 126, a comfortable, substantially pressureless, and precise fitting solution to the wearer's ear is achieved. Furthermore, as discussed above, several features are provided to obtain a slimmer and sleeker design with convenient portability. For example, damper rims 126 not only provide a protective cover for the engagement mechanisms 116, but also provide an element of aesthetic appeal by mimicking the look, and color, of a traditional speaker cone surround. Moreover, the size and positioning of the damper rims 126 and the placement of batteries 140 in the arms 112 reduces the overall thickness of the ear-cups 102, thereby increasing the commercial appeal and usability of the headphone 100.

It should be emphasized that the above-described embodiments, particularly, any "preferred" embodiments, are possible examples of implementations, merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and protected by the following claims.

What is claimed:

1. A headphone assembly, comprising:

a headband assembly comprising at least one end;

an ear-cup assembly pivotably engaged to the headband assembly by an engagement structure positioned proximate to the at least one end of the headband assembly, the ear-cup assembly defining a transducer chamber having a fixed volume;

a transducer configured to produce sound and positioned within the fixed volume located inside of the ear-cup assembly; wherein the ear-cup assembly comprises an ear-cup housing defining a portion of the transducer chamber positioned behind the transducer; and a damper rim positioned between the ear-cup assembly and the at least one end of the headband assembly, the damper rim covering the engagement structure and being engaged to the ear-cup assembly and the at least one end of the headband assembly.

2. The headphone assembly of claim 1, wherein the engagement structure includes a ball-and-socket joint that pivotably connects the ear-cup assembly to the at least one end of the headband assembly.

3. The headphone assembly of claim 1, wherein the engagement structure includes a circular assembly coupled to a circular receptacle to pivotably connect the ear-cup assembly to the at least one end of the headband assembly.

4. The headphone assembly of claim 1, wherein the damper rim is positioned substantially parallel to the at least one end of the headband assembly.

5. The headphone assembly of claim 1, wherein the damper rim is configured to dampen movement of the ear-cup assembly relative to the handband assembly.

6. The headphone assembly of claim 1, wherein the damper rim is composed of rubber.

7. The headphone assembly of claim 1, further comprising:

an outer cap removably coupled to the at least one end of the headband assembly; and a battery compartment positioned within the at least one end of the headband assembly, the battery compartment housing batteries that provide operational power to the headphone assembly, wherein the outer cap is removable to provide access to the battery compartment.

8. A headphone assembly, comprising:

a headband assembly comprising at least one end;

an ear-cup housing being pivotably coupled to the headband assembly at a position adjacent the at least one end and defining a transducer chamber having a fixed volume;

an acoustic transducer positioned within the transducer chamber wherein a portion of the fixed-volume transducer chamber is positioned between the transducer and the at least one end of the headband assembly; and a damper rim extending between the ear-cup housing and the headband assembly.

9. A headphone assembly according to claim 8, further comprising an engagement structure configured to pivotably couple the ear-cup housing to the headband assembly at the position adjacent the at least one end.

10. A headphone assembly according to claim 8, further comprising an ear-cup cap positioned opposite a portion of the ear-cup housing relative to the transducer.

11. A headphone assembly according to claim 10, wherein the ear-cup cap comprises a grid-like surface for enabling sound from the radiator to radiate outwardly.

12. A headphone assembly according to claim 8, wherein the damper rim is configured to dampen articulation of the ear-cup relative to the headband assembly.

13. A headphone assembly according to claim 9, wherein the damper rim obscures the engagement structure.

14. A headphone assembly according to claim 8, wherein the headband assembly defines a bowed shape and comprises a folding mechanism to permit the ear-cup housing and the corresponding at least one end to be rotated inwardly toward an internal region defined by the headband assembly.

15. A headphone assembly according to claim 8, wherein the at least one end comprises a first end and wherein the headband assembly further comprises:

a second end positioned opposite the first end;

a first arm corresponding to the first end and a second arm corresponding to the second end; and an arcuate headband positioned between and movably coupled to each of the first arm and the second arm;

wherein the ear-cup housing comprises a first ear-cup housing and the headphone assembly further comprises a second ear-cup housing, wherein the first ear-cup housing is pivotably coupled to the first arm and the second ear-cup housing is pivotably coupled to the second arm.

16. A headphone assembly according to claim 15, wherein the first arm is slidably coupled to the arcuate headband.

17. A headphone assembly according to claim 15, wherein the first arm is hingedly coupled to and inwardly foldable relative to the arcuate headband.

18. A headphone assembly according to claim 15, wherein each of the first arm and the second arm is slidably and rotatably coupled to the arcuate headband.

* * * * *